United States Patent [19]

Martin

[11] 4,438,588

[45] Mar. 27, 1984

[54] REMOTE CONTROL BALL

[76] Inventor: John E. Martin, 5 Belfast Rd., Timonium, Md. 21093

[21] Appl. No.: 427,890

[22] Filed: Sep. 29, 1982

[51] Int. Cl.[3] ..... A63H 17/28

[52] U.S. Cl. ..... 46/228; 46/269

[58] Field of Search ..... 46/250, 251, 252, 253, 46/254, 256, 87, 88, 91, 93, 206, 202, 269; 180/10, 9; 272/115; 104/78, 77; 305/34, 19; 280/DIG. 7

[56] References Cited

U.S. PATENT DOCUMENTS

| | | | |
|---|---|---|---|
| 2,004,791 | 6/1935 | Korte | 46/230 |
| 2,361,165 | 10/1944 | Arthur | 180/9 |
| 2,939,246 | 6/1960 | Glos | 46/269 |
| 2,949,696 | 8/1960 | Easterling | 46/269 |
| 2,949,697 | 8/1960 | Licitis et al. | 46/269 |
| 3,205,962 | 1/1961 | Anderson | 280/DIG. 7 |
| 3,428,015 | 12/1966 | Cloud | 272/1 E |
| 3,500,579 | 3/1970 | Bryer | 46/269 |
| 3,696,557 | 10/1972 | Ruppel | 46/253 |
| 3,722,134 | 3/1973 | Merrill | 46/206 |
| 3,798,835 | 3/1974 | McKeehan | 46/243 |
| 4,096,919 | 6/1978 | Thompson | 280/DIG. 7 |

FOREIGN PATENT DOCUMENTS

| | | | |
|---|---|---|---|
| 1292441 | 10/1972 | United Kingdom | 46/243 |

*Primary Examiner*—Robert A. Hafer
*Assistant Examiner*—Perry Knutson
*Attorney, Agent, or Firm*—John F. McClellan, Sr.

[57] ABSTRACT

An improved system of the type having a ball or sphere and within it a remote-control powered vehicle, has provisions for determining vehicle orientation for more efficient control including one or more of: transparent ball portions, color ball portions and forward-illuminating spotlight; ability to store the vehicle with the ball inflated is provided by a mercury switch which turns off power when the vehicle is inverted; angle strips improve traction externally and a soft, semi-inflated ball is used for better internal traction between vehicle and ball wall; charging of vehicle batteries through the ball wall is disclosed.

6 Claims, 8 Drawing Figures

REMOTE CONTROL BALL

This invention relates to powered vehicles and specifically to a remote control ball.

SUMMARY OF THE INVENTION

A principal object of the invention is to provide an improved system of the remote control ball type.

In the prior art a remote control ball has been suggested in British Pat. No. 1,292,441 issued to J. G. T. Almond, Oct. 11, 1972, which generally comprises "a hollow sphere and an internal unit". This may be powered and the "internal unit can also be radio controlled by known means used, for instance, for remote control of toy planes".

Representing other sphere-enclosed vehicles as a type is that disclosed in U.S. Pat. No. 3,798,835 issued to Rodger W. McKeehan on Mar. 26, 1974.

However, the prior art known fails to provide certain specific, important advantages and therefore further objects are to provide a system as described with these advantages.

This invention has actually been reduced to practice with several of these advantages.

For example, it is a pleasure to cause the ball of this invention to roll along a grassy shore, then to direct it into the stream or pond, where it rolls along in various directions as desired, and then orient it so that it comes ashore again, and stops at the feet of an observer, for example, but depends on the remote controller's being able to keep track of the rolling ball (or of the stopped ball, if floating). This invention provides simple means for determining the location and orientation of the ball.

Exceptional traction up wet slopes and on fast or rough water is essential, and is further provided by the invention.

Further objects are to provide improved access for control within the ball not desired to be actuated remotely, and to provide a simplified and protected air-lock opening and closure for the ball.

Yet further objects are to provide a system as described which can be stored inflated if desired, without necessity for opening the ball, or can be stored deflated and quickly reinflated for use, which will not cause injury, and will not damage property, which is economical, easy and fun to operate by children as well as adults.

Still further objects are to provide a system as described in which the elements can be used in cooperation separately but as a fun game, which is suited for use at night as well as in the daytime, which requires no bracing, which is adapted for simplified low cost embodiment, for recharging without deflation, and which can give remote indication of speed as well as direction.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
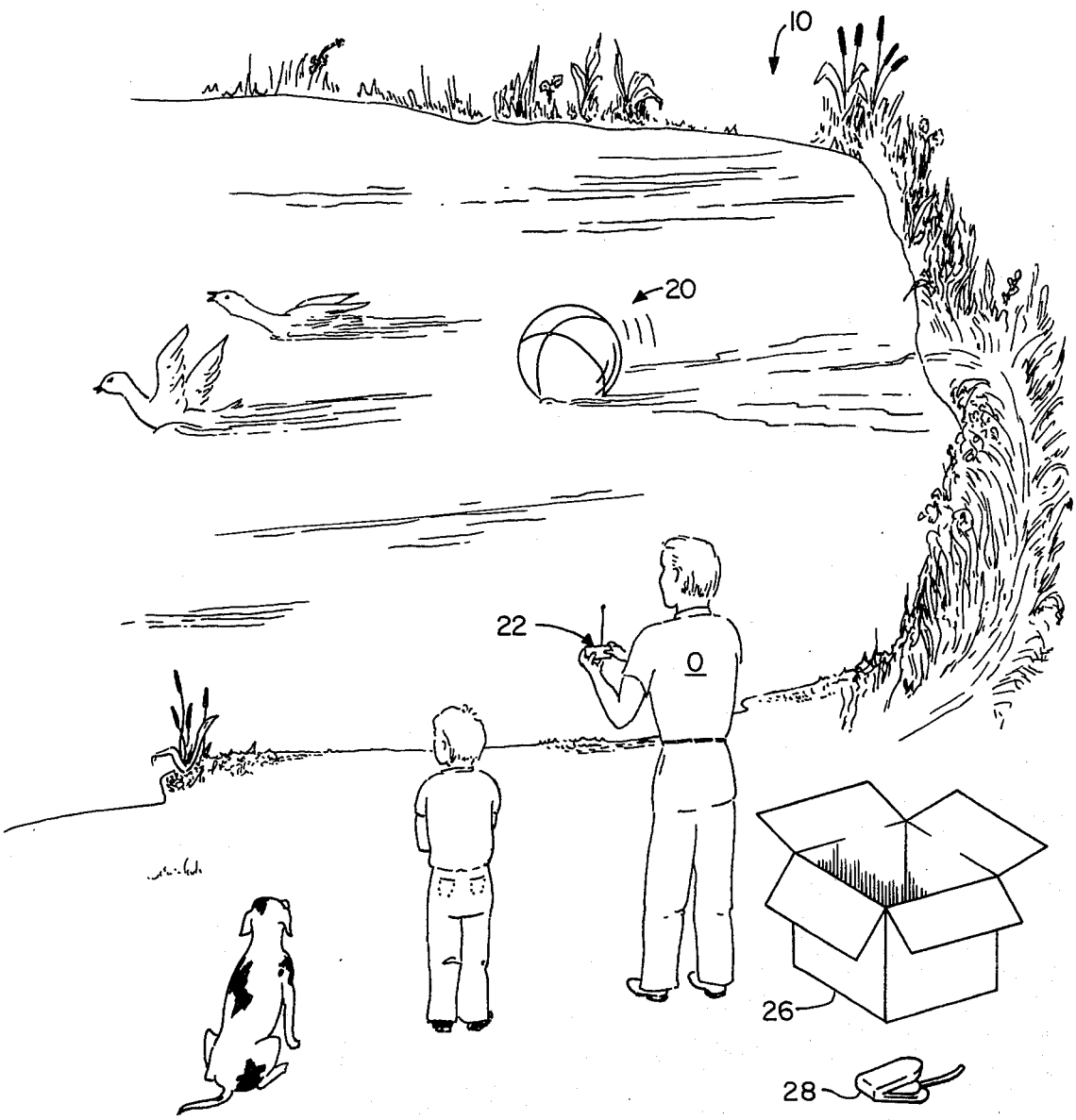
FIG. 1 is a perspective view of the invention in use in land and water environment.

FIG. 1 shows the invention in embodiment 10 in use "rounding-up ducks" to illustrate remote-control of the powered ball 20 on land and on water.

The operator O has a radio transmitter 22 signalling an internal mechanism in the ball, to control ball rotation and direction. The ball may be a common plastic-film beach ball suitably adapted for receiving the internal mechanism, and for better traction provided with traction fins, described later, if desired.

The entire unit is readily carried inflated or it may be carried collapsed in a small box 26 and inflated at the side as by means of a conventional high-volume low pressure air-mattress pump 28. The ball may be 29.5 inches (74.9 cm) in diameter, when inflated.

Figure 2:
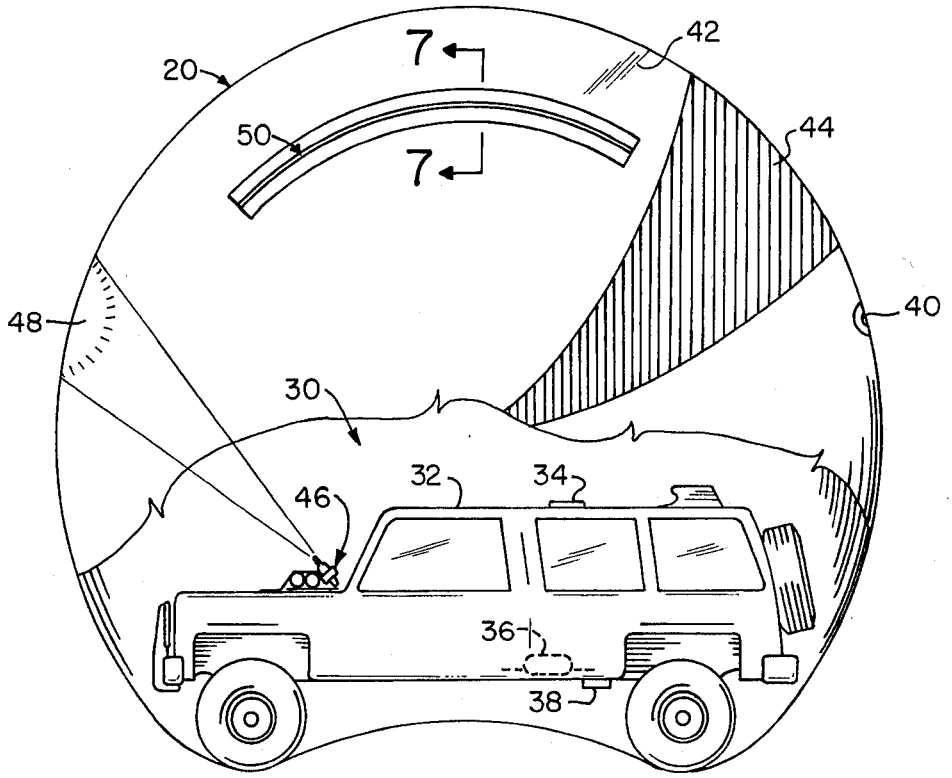
FIG. 2 is a side elevational view partially in section showing inner and outer elements of the invention.

FIG. 2 shows that the basic controllable power unit or inner unit 30 may include a commercially obtainable scale model radio-operated vehicle 32. Indicated is Model 1126 remotely steerable "MOUNTAIN MAN R C CHEVY BLAZER" with remote control of forward and reverse. This is made by "Shinsei" and is widely available commercially, complete with the radio control unit, at this time for about $100.00; batteries cost $11.00. Two-wheel or four-wheel drive is selectable at top switch 34. This unit 32 is 12.75 inches (32.4 cm) long, 6.175 inches (17.1 cm) wide, 6.25 inches (15.9 cm) high and weighs 5 lbs. (2.3 kg).

One or more modifications or additions to this unit may be useful according to this invention.

To provide automatic cut-off of power without deflation when the unit is to be stored inflated, ready for instant use, a mercury switch 36 may be added in series with the battery power supply. When the inner unit 30 is inverted by manual, quick sideways roll of the ball 20, power is turned off. In the inverted position also, switch 34 can be manipulated through the ball material at the bottom to shift from two wheel to four wheel drive. If desired, an additional switch 38 under the vehicle and in series with the vehicle battery supply can be manipulated similarly to control power. Concavity at the ball bottom may be from water or grass pressure. For best traction on land and on water, the ball is preferably slackly inflated, by means of conventional nipple 40; to the extent that the wheel bottom surfaces are the lowest points, the soft, flexible ball material tends to wrap around an arc of the wheel providing greater area contact enabling the inner unit 30 to "climb" the ball inner surface more reliably, rotating the ball 20. Steering to right or left causes the wheels to "climb" to right or left correspondingly turning the ball to right or left.

A control problem is that of always knowing the forward orientation or location of the front end of the inner unit. Without knowing the orientation the user must try first one control signal and then another until the orientation becomes clear through observation of rotation of the ball. When wind or current or both act on the ball, the problem is more complex; distance can compound this, and the control is usable up to one hundred feet (30 meters) or more. Low light levels can make the problem even harder to solve. Many times the ball cannot be approached, as when on water.

Three provisions of the invention separately or in combination can help with this problem. First, the ball can at selected locations be semi-transparent or light conductive as at 42 for direct view of the inner unit 30. Second, the ball can have markings exemplified by color patches 44 on it, which may also be light conductive, to make rotation easier to see. Third, the inner unit can have a battery-powered spotlight 46 clipped or taped to the front, aimed toward the front and preferably angled upwardly for better visibility, to project a bright spot of light 48 on the ball at a known particular location relative to the vehicle.

Even in absolute darkness, location of the front of the vehicle is easily determined by the illumination and ball rotation is made apparent by passage of the areas of color, periodially changing color of the light spot. Very eerie and beautiful effects are provided at night by the illumination.

To get the inner unit 30 inside the ball 20 a suitable, closable opening 50 is provided. The structure of this may be less light-conductive than other parts of the ball so that it also may modulate the illumination when passing the particular location relative to the vehicle. Other details are described later.

Figure 3:
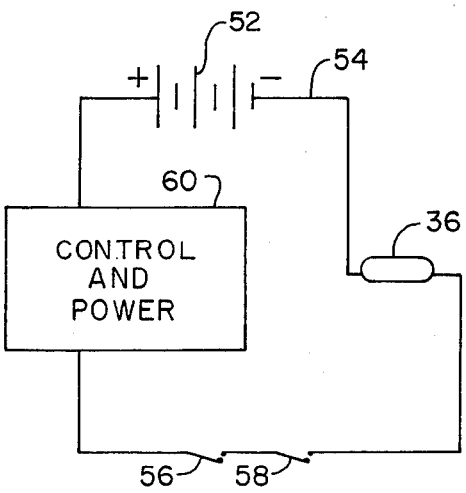
FIG. 3 is a wiring diagram of the power system.

FIG. 3 shows diagrammatically how the inner unit battery supply 52 may be wired in series circuit 54 with the mercury switch 36 and one or more manual on-off switches 56, 58 and the motor and motor radio control 60 of the vehicle. Gearing may transmit power to the wheels.

Figure 4:
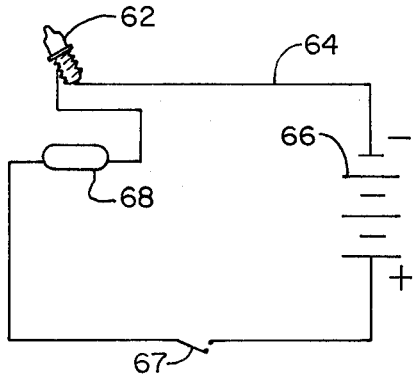
FIG. 4 is a wiring diagram of a light system.

FIG. 4 shows that the "penlight" bulb 62 or other suitable spotlight bulb may be wired in series circuit 64 also with the batteries 66 for it and a mercury switch 68, (and may have in addition a manual on-off switch 67).

Figure 5:
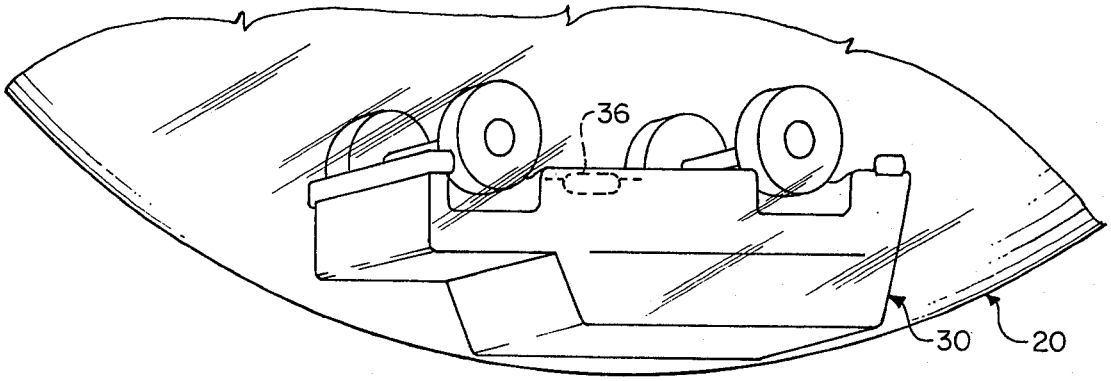
FIG. 5 is a detail of a mode of storage inflated.

FIG. 5 shows the inner unit 30 inverted within the outer unit or ball 20 at the bottom, in position for storage inflated with the mercury switch 36 (or switches) turning off the power, eliminating need to deflate and keeping the system ready for instant use.

Figure 6:
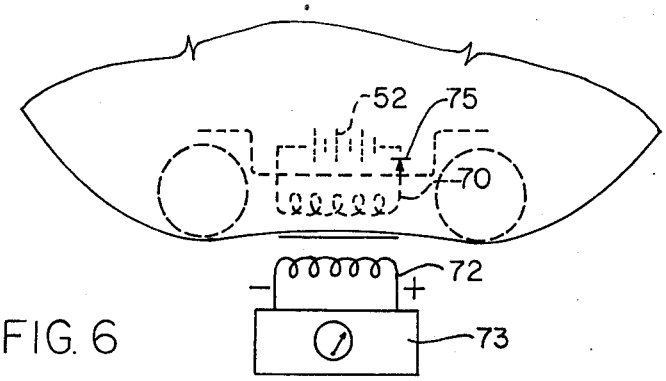
FIG. 6 is a schematic detail of a battery charging option.

FIG. 6 shows the possibility of charging the inner unit batteries 52 without deflating, by means of inductive coupling between an inner coil 70 in series with the batteries and outer coil 72 connected with any suitable charging source 73. Pulsating D.C. may be used, if desired, with a rectifier 75 in the battery circuit, or any other suitable conventional means.

Figure 7:
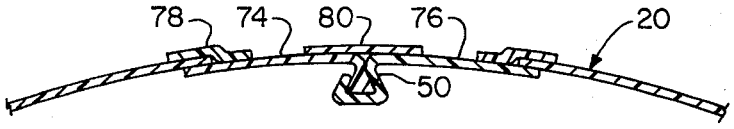
FIG. 7 is a sectional, enlarged detail taken at 7—7, FIG. 2 of a ball-sealing provision.

FIG. 7 shows that for quick but secure access to the ball interior a tongue-and-groove type plastic closure 74, 76, may be used to close opening 50 in the ball 20; both closure and ball may be of polyethylene. Tape 78 may be used to adhere the two tongue and groove parts 74, 76 to the ball and a strip of tape 80 may be adhered as a guard over the tongue and groove closure.

Figure 8:
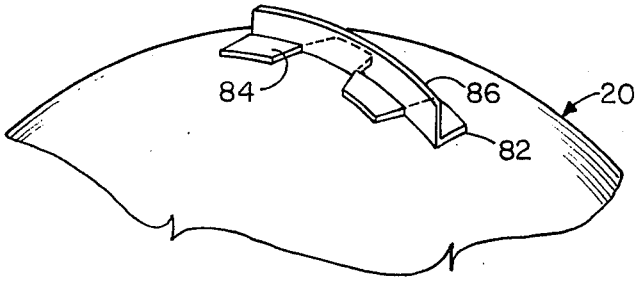
FIG. 8 is a fragmentary detail of a traction fin.

FIG. 8 shows a strip of plastic angled with one leg 84 82 notched and cemented flat to the ball 20 and the other leg upstanding as a traction strip 86. Alternate notched flaps of the leg cemented to the ball preferably point in opposite directions. These strips may be disposed as meridians and parallels, or in other conventional patterns. The traction strips will lessen light conductivity in the manner of the other ball-surface features described, and helpfully modulate the light also.

In conclusion, it will be appreciated that the invention provides in closely co-acting aspects:

a more practical system for air handling, with special through-the-ball access structure which double-seals the access opening; mercury (or other gravity-sensitive) switch for deactivating the vehicle and light without need for deflating, keeping the system ready for instant use on re-righting the vehicle; remote charging of the vehicle battery without need for deflating the ball, manual access for control switching on the vehicle through the slack bottom of the ball;

a most useful aid to knowing information about both the inside and outside of the ball system, which way to operate the "joy stick" of the remote radio control to achieve desired, positive reaction of the ball, whether reverse or forward or left or right, by observation of the light, and similarly, how fast the ball is rotating, if at all;

water adaption by means of the light provisions which are most useful in wind and current and when the ball cannot be approached; and by means of fins and double sealing;

attractive effects by color and light, day and night;

economy, by using as much existing equipment as possible.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of hollow ball and vehicle with wheels, steering and a power circuit for same, and means for remotely controlling steering and forward-reverse direction of the vehicle, the improvement comprising: means for increasing wheel traction on the ball inner surface comprising: said ball being inflatable and of soft flexible material which when the ball is partially inflated can wrap partially around said wheels for increasing traction area, means for indicating forward orientation of said vehicle for purposes of said remote control, including said ball being at least in part light-conductive, means for illuminating said light conductive part of said ball when said light conductive part is at a particular location generally ahead of said vehicle, said means for illuminating comprising a light on a forward part of said vehicle, and said means for indicating also indicating rotation of said ball and comprising means for modulating said illuminating when the ball is rotating.

2. In a system as recited in claim 1, said means for modulating including color modulation by means of a light conductive ball portion of a different color from said light conductive part, said means for modulating further including ball-traction improving fin structure at spaced locations on the outside of the ball, said fin structure producing less light conduction than said light conductive part when at said particular location, and said means for modulating further including closable opening structure on the ball, said closable opening structure producing less light conduction than said light conductive part when at said particular location.

3. In a system as recited in claim 2, said closurable-opening construction including a tongue and groove type closure, a guard thereover, and means affixing said tongue and groove type closure to said ball.

4. In a system as recited in claim 3, said guard and said means affixing including an adhering tape.

5. In a system as recited in claim 1, a control switch on an upper part of said vehicle, and means for actuating said control switch without deflating said ball, comprising said control switch being accessible for manual operation through the ball when said vehicle is inverted.

6. In a system as recited in claim 5, said vehicle power circuit including a rechargeable battery, and means for recharging said battery without deflating said ball, comprising first inductive means on said vehicle adjacent a lower portion of said ball, a charging source, and second inductive means on said charging source positionable adjacent said first inductive means for charging said rechargeable battery.

* * * * *